US007500865B2

(12) United States Patent
Natter et al.

(10) Patent No.: US 7,500,865 B2
(45) Date of Patent: Mar. 10, 2009

(54) ELECTRICAL CONNECTOR

(75) Inventors: Brantley Natter, Brighton, MI (US); Herbert Plate, Lüdenscheid (DE)

(73) Assignee: Kostal Kontakt Systems GmbH, Ludenscheid (DE)

( * ) Notice: Subject to any disclaimer, the term of this patent is extended or adjusted under 35 U.S.C. 154(b) by 0 days.

(21) Appl. No.: 11/825,811

(22) Filed: Jul. 9, 2007

(65) Prior Publication Data

US 2008/0050957 A1 Feb. 28, 2008

(30) Foreign Application Priority Data

Jul. 17, 2006 (DE) ..... 10 2006 033 323

(51) Int. Cl.
*H01R 13/627* (2006.01)

(52) U.S. Cl. ..... 439/362; 439/924.2

(58) Field of Classification Search ..... 439/924.2, 439/924.1, 359, 362, 364, 638, 640, 641, 439/527

See application file for complete search history.

(56) References Cited

U.S. PATENT DOCUMENTS

| | | | | |
|---|---|---|---|---|
| 4,614,877 | A | 9/1986 | Knesewitsch et al. | |
| 5,217,386 | A * | 6/1993 | Ohsumi et al. | 439/364 |
| 6,325,648 | B1 * | 12/2001 | Bilezikjian et al. | 439/924.2 |
| 6,982,393 | B2 | 1/2006 | Matsui et al. | |
| 7,241,189 | B2 | 7/2007 | Mohs et al. | |
| 2005/0098419 | A1 | 5/2005 | Matsui et al. | |
| 2007/0066152 | A1 | 3/2007 | Mohs et al. | |

FOREIGN PATENT DOCUMENTS

| | | |
|---|---|---|
| DE | 34 10 194 A1 | 9/1985 |
| DE | 37 35 164 C1 | 11/1988 |
| DE | 296 17 113 U1 | 11/1996 |
| DE | 10 2004 054 360 A1 | 6/2005 |
| DE | 10 2004 015 345 | 10/2005 |

* cited by examiner

*Primary Examiner*—Felix O Figueroa
(74) *Attorney, Agent, or Firm*—Brooks Kushman P.C.

(57) ABSTRACT

An electrical connector includes two connector parts each having a high-load ("HL") housing with an HL contact and a low-load ("LL") housing with a LL contact. One LL housing is movable relative to the other LL housing. The parts are movable to join and separate from one another. The HL housings join upon the parts joining such that the HL contacts join and establish a HL connection. The LL housings join after the one LL housing moves toward the other LL housing while the parts are joined such that the LL contacts join and establish a LL connection. The LL connection is prevented from being established until the HL connection is established as the LL housings are prevented from joining until the HL housings join. The HL connection is prevented from separating until the LL connection is separated as the HL housings are prevented from separating until the LL housings separate.

10 Claims, 3 Drawing Sheets

ELECTRICAL CONNECTOR

CROSS-REFERENCE TO RELATED APPLICATIONS

This application claims foreign priority benefits under 35 U.S.C. § 119(a)-(d) to DE 10 2006 033 323.3, filed Jul. 17, 2006, which is hereby incorporated by reference in its entirety.

BACKGROUND OF THE INVENTION

1. Field of the Invention

The present invention relates to an electrical connector for establishing an electrical high-load ("HL") connection(s) and an electrical low-load ("LL") connection(s) in which the LL connection cannot be closed until the HL connection is closed and the HL connection cannot be separated until the LL connection is separated.

2. Background Art

DE 10 2004 054 360 A1 (corresponding to U.S. Pat. No. 6,982,393) describes an electrical connector which includes power terminals and attachment-sensitive terminals. Via a lever, the power terminals are connected to one another and then the attachment-sensitive terminals are connected to one another. The attachment-sensitive terminals actuate a relay such that the. relay disconnects an electrical connection with the terminals of a power supply. As a result, current does not flow through the power terminals until the power terminals are completely connected to one another and the power terminals can only be separated from one another in a current-free state. The connector is designed as a single-pole lever switch which is able to establish only one power connection. If multiple power connections are to be established, then either a corresponding number of single-pole lever switches or a multi-pole switching variant having a relatively complex switch structure is required.

It is a problem if electrical feed lines for an electrical high-load connection(s) and an electrical low-load connection(s) are supplied to an electrical connector in parallel as the connector is therefore situated at the end point of the feed lines making it difficult to insert the connector into a cable harness to be installed.

SUMMARY OF THE INVENTION

An object of the present invention includes an electrical connector which allows current-free and/or voltage-free joining of an electrical high-load connection(s) and which is easily and economically manufactured and installed while avoiding the above-noted disadvantages.

In carrying out the above object and other objects, the present invention provides an electrical connector having first and second connector parts. The first connector part has a first high-load ("HL") housing with a first HL contact and a first low-load ("LL") housing with a first LL contact. The first LL housing is movably connected to the first HL housing to move along a plug-in path in opposite first and second directions. The second connector part has a second HL housing with a second HL contact and a second LL housing with a second LL contact. The connector parts are movable relative to one another along the plug-in path to join together and are movable relative to one another along the plug-in path to separate from one another. The HL housings join together upon the connector parts joining together such that the HL contacts join together and establish an electrical HL connection. The LL housings join together after the first LL housing is moved in the first direction along the plug-in path toward the second LL housing while the connector parts are joined together such that the LL contacts join together and establish an electrical LL connection.

The connector further includes a lock. The lock is associated with the first and second connector parts. The lock is operable to prevent the first LL housing from joining with the second LL housing such that the LL connection is established until the HL housings join together such that the HL connection is established. The lock is further operable to prevent the HL housings from separating from one another such that the HL connection is not established until the first LL housing separates from the second LL housing such that the LL connection is not established.

Also, in carrying out the above object and other objects, the present invention provides another electrical connector. This electrical connector also includes first and second connector parts. The first connector part has a first HL housing with a first HL contact and a first LL housing with a first LL contact. The first LL housing is movable along a plug-in path in opposite first and second directions. The second connector part has a second HL housing with a second HL contact and a second LL housing with a second LL contact. The connector parts are movable relative to one another along the plug-in path to join together and are movable relative to one another along the plug-in path to separate from one another. The HL housings join together upon the connector parts joining together such that the HL contacts join together and establish an electrical HL connection. The LL housings join together after the first LL housing is moved in the first direction along the plug-in path toward the second LL housing while the connector parts are joined together such that the LL contacts join together and establish an electrical LL connection. The LL connection is prevented from being established until the HL connection is established as the first LL housing is prevented from joining with the second LL housing until the HL housings join together. The HL connection is prevented from being separated until the LL connection is separated as the HL housings are prevented from separating from one another until the first LL housing separates from the second LL housing.

Electrical connectors in accordance with embodiments of the present invention includes first and second plug-in connector parts. The connector parts are joinable to one another along a vertical plug-in direction to form the connector. Likewise, the connector parts may be separated from one another.

The first connector part includes a first HL housing and a first LL housing. The first HL housing contains a first set of electrical HL contacts and the first LL housing contains a first set of electrical LL contacts. The interior of the first HL housing is divided into chambers for respectively holding the HL contacts such that the HL contacts are insulated from one another. This insulation is advantageous when terminal lines connected to the HL contacts conduct high voltages. The HL contacts have a sufficiently large cross-section for accommodating high-current applications.

Similarly, the second connector part includes a second HL housing and a second LL housing. The second HL housing contains a second set of electrical HL contacts and the second LL housing contains a second set of electrical LL contacts. The interior of the second HL housing is also divided into chambers for respectively holding the HL contacts such that the HL contacts are insulated from one another. These HL contacts also have a sufficiently large cross section for accommodating high-current applications.

The first LL housing is movably connected to the first HL housing such that the first LL housing is vertically movable along the plug-in direction. The second LL housing is fixedly connected to the second HL housing to stay in place. The second LL housing may be in the form of an integrally molded chamber to be a component of the second HL housing.

The HL contacts of the HL housings are for establishing an electrical HL connection(s). To this end, respective pairs of the HL contacts of both HL housings join one another when the connector parts are joined to one another in order to establish an HL connection(s). In this event, the respective pairs of HL contacts join one another to establish the HL connection(s) as the HL housings of the connector parts are joined to one another. Likewise, the LL contacts of the LL housings are for establishing an electrical LL connection(s). To this end, respective pairs of the LL contacts of both LL housings may join one another when the connector parts are joined to one another in order to establish an LL connection(s). In this event, the respective pairs of LL contacts join one another to establish the LL connection(s) upon the LL housings of the connector parts joining one another. Unlike the HL housings, the LL housings do not join one another upon the connector parts joining one another. In contrast, the LL housings join one another upon the first LL housing being vertically moved along the plug-in direction toward the second LL housing to join with the second LL housing while the connector parts are joined together.

An electrical connection with HL terminal lines of the HL connection is established or separated via the LL connection by a power control circuit such as a relay or an electronic circuit breaker. The HL connection is not established until the LL contacts are joined together in both LL housings of both connector parts. As described above, the first LL housing is movably connected to the first HL housing In an embodiment of an electrical connector in accordance with the present of the first connector part and the second LL housing is fixedly connected to the second HL housing of the second connector part. As a result, the first and second LL housings are respectively situated on their associated HL housing such that the LL connection is not closed until the HL housings are completely joined to one another.

Accordingly, hazardous high voltages on the HL contacts are prevented when the connector parts are not connected to one another, and high current flow through the HL contacts is prevented when the connector parts are not yet completely connected to one another.

In an embodiment of an electrical connector in accordance with the present invention, each LL housing is fixedly connected to its associated HL housing such that the LL connection is not established until the HL connection is completely or at least almost completely established.

In an embodiment of an electrical connector in accordance with the present invention, at least one LL housing is movable with respect to its associated HL housing such that the LL connection may be manually established independent of the HL connection. A slider coupled to the first connector part prevents the LL connection from being established until the HL connection is completely established and until the HL housings are fastened to one another by a lock. The slider prevents the lock from being released while the LL housings are joined together. Thus, the HL housings and the HL contacts situated therein cannot be separated from one another until the terminal feed lines thereof are switched to a current-free state and/or a voltage-free state.

DETAILED DESCRIPTION OF THE PREFERRED EMBODIMENT(S)

Figure 1:
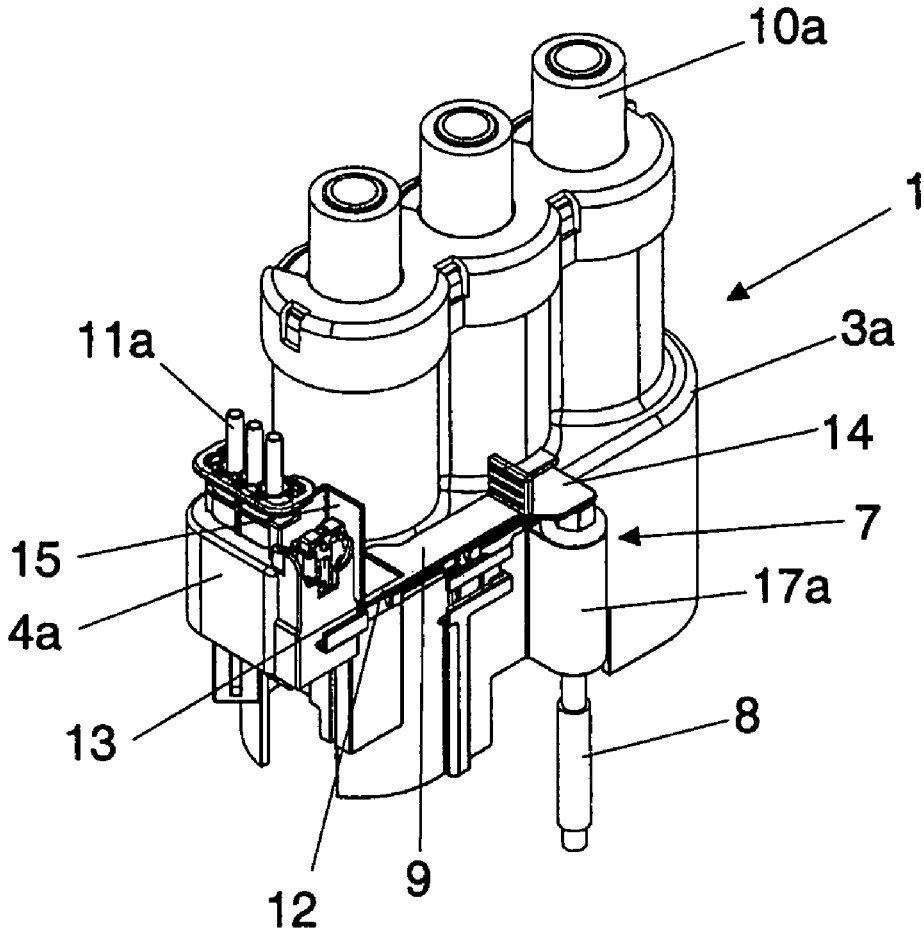
FIG. 1 illustrates a first plug-in connector part of an electrical connector in accordance with an embodiment of the present invention.
Figure 2:
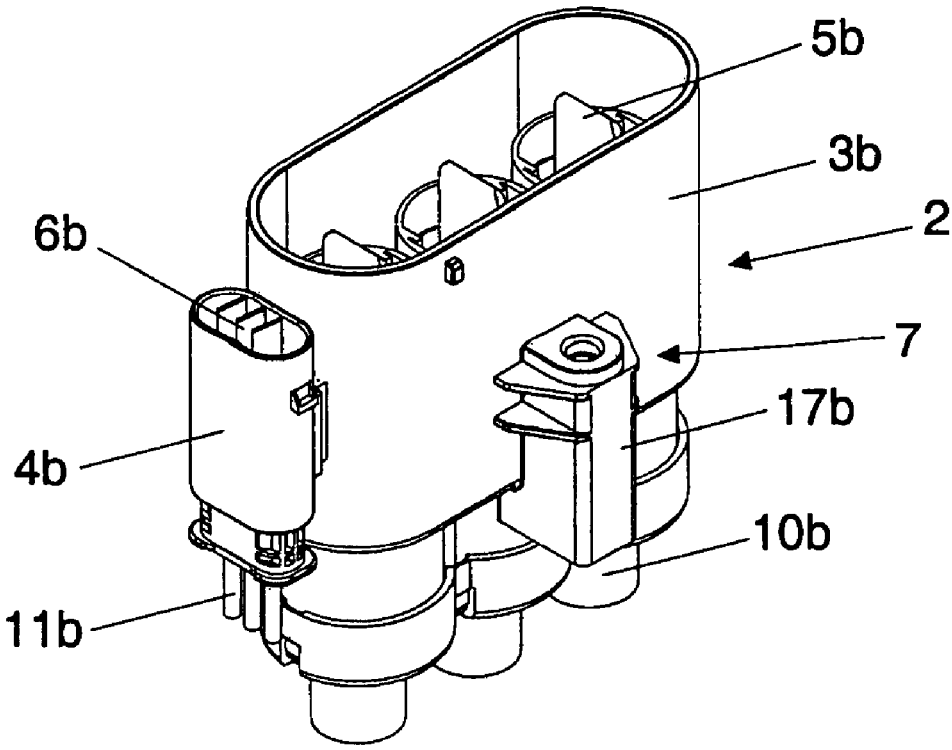
FIG. 2 illustrates a second plug-in connector part of the electrical connector.

Referring now to FIGS. 1 and 2, a first plug-in connector part 1 and a second plug-in connector part 2 of an electrical connector in accordance with an embodiment of the present invention are respectively shown. Connector parts 1, 2 are joinable to one another along a vertically oriented plug-in direction. Likewise, connector parts 1, 2 may be separated from one another along the plug-in direction.

First connector part 1 includes a high-load ("HL") housing 3*a* and a low-load ("LL") housing 4*a*. LL housing 4*a* is situated on a side wall of HL housing 3*a* so as to be vertically movable in the plug-in direction. LL housing 4*a* is vertically movable in the plug-in direction by a linear guide designed as, for example, a dovetail guide. Electrical HL contacts 5*a* are in HL housing 3*a* and electrical LL contacts 6*a* are in LL housing 4*a* (see FIG. 3 which shows contacts 5*a*, 6*a* without the surrounding housings 3*a*, 4*a*).

Similarly, second connector part 2 includes a HL housing 3*b* and a LL housing 4*b*. LL housing 4*b* is immovably fastened to HL housing 3*b*. Electrical HL contacts 5*b* are in HL housing 3*b* and electrical LL contacts 6*b* are in LL housing 4*b*. As shown in FIG. 2, HL contacts 5*b* are flat connector-type contacts whereas LL contacts 6*b* are correspondingly designed with a smaller cross section.

HL housings 3*a*, 3*b* are for establishing an electrical HL connection(s) whereas LL housings 4*a*, 4*b* are for establishing an electrical LL connection(s). As such, HL contacts 5*a*, 5*b* are for use with relatively high currents and/or voltages whereas LL contacts 6*a*, 6*b* are for use with relatively low currents and/or voltages. DE 10 2004 015 345 A1 (corresponding to U.S. Patent Application Pub. No. 2007/0066152) describes a possible design of HL contacts 5*a*.

Contacts 5*a*, 6*a* of first connector part 1 have a corresponding socket-like design to contacts 5*b*, 6*b* of second connector part 2. As such, corresponding pairs of HL contacts 5*a*, 5*b* join one another when HL housings 3*a*, 3*b* join one another when connector parts 1, 2 are joined together. To this end, HL housings 3*a*, 3*b* join one another upon connector parts 1, 2 joining together. As such, the joining of HL housings 3*a*, 3*b* to one another occurs in response to connector parts 1, 2 joining together. Likewise, corresponding pairs of LL contacts 6*a*, 6*b* join one another when LL housings 4*a*, 4*b* join one another when connector parts 1, 2 are joined together. To this end, LL housings 4*a*, 4*b* join one another when LL housing 4*a* is vertically moved along the plug-in direction toward LL housing 4*b* while connector parts 1, 2 are joined together. As such, the joining of LL housings 4*a*, 4*b* to one another occurs in response to LL housing 4*a* moving toward LL housing 4*b* while connector parts 1, 2 are joined together.

HL terminal lines 10*a* are respectively connected to HL contacts 5*a* of HL housing 3*a* of first connector part 1. Likewise, LL terminal lines 11*a* are respectively connected to LL contacts 6*a* of LL housing 4*a* of first connector part 1. Similarly, HL terminal lines 10*b* are respectively connected to HL contacts 5*b* of HL housing 3*b* of second connector part 2. Likewise, LL terminal lines 11*b* are respectively connected to LL contacts 6*b* of LL housing 4*b* of second connector part 2.

HL terminal lines 10*a*, 10*b* have a relatively large cross section whereas LL terminal lines 11*a*, 11*b* have a relatively small cross section. HL terminal lines 10*a*, 10*b* and HL contacts 5*a*, 5*b* are for use with relatively high currents and/or voltages. LL terminal lines 11*a*, 11*b* and LL contacts 6*a*, 6*b* are for use with relatively low currents and/or voltages.

LL terminal lines 11*a*, 11*b* are connected to an electrical circuit breaker such as a relay or the like. The circuit breaker establishes an electrical connection with HL contacts 5*a*, 5*b* when LL contacts 6*a*, 6*b* are joined together. Conversely, the circuit breaker interrupts this electrical connection with HL contacts 5*a*, 5*b* when LL contacts 6*a*, 6*b* are not joined together.

First connector part 1 includes a slider 9 which is used to ensure that connector parts 1, 2 can be joined together or separated from one another only in current-free and/or voltage-free states. Slider 9 is transversely movable to the vertical plug-in direction of connector parts 1, 2. In FIG. 1, slider 9 is in a position in which an end 14 of slider 9 overlaps a molded-on element 17*a* on HL housing 3*a* of first connector part 1. A locking bolt 8 having a threaded section is guided through and supported by molded-on element 17*a*. Bolt 8 supported in molded-on element 17*a* together with a molded-on element 17*b* on HL housing 3*b* of second connector part 2 forms a lock 7. Lock 7 is movable between a locked position and an unlocked position. In the locked position, lock 7 prevents a joining of connector parts 1, 2 from unintentionally separating. In the unlocked position, lock 7 allows a joining of connector parts 1, 2 to be separated.

Slider end 14 prevents access to lock 7 when slider 9 is in the position shown in FIG. 1. Lock 7 may be released by transversely moving slider 9 in the direction toward LL housing 4*a*. In this position, a projection 12 on slider 9 engages beneath an edge 13 of a wall 15 on LL housing 4*a*. Wall 15 is integrally molded onto LL housing 4*a*. In this manner, slider 9 prevents LL housing 4*a* from vertically moving along the plug-in direction toward LL housing 4*b*.

Figure 3:
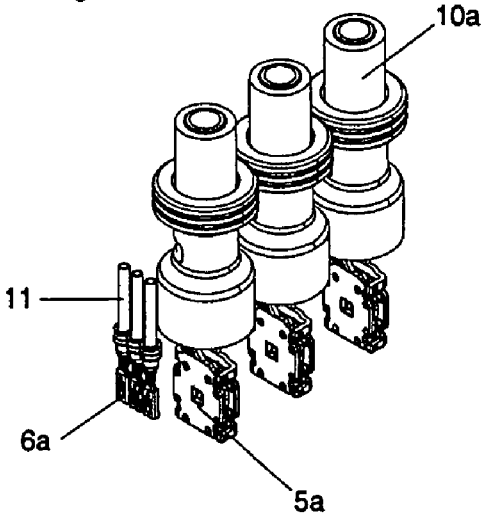
FIG. 3 illustrates high-load contacts and low-load contacts of the first connector part.
Figure 4:
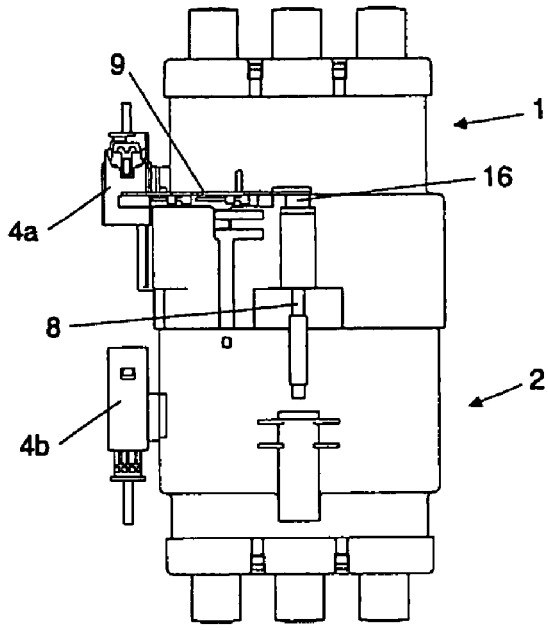
FIG. 4 illustrates a first connection phase for joining the connector parts.
Figure 5:
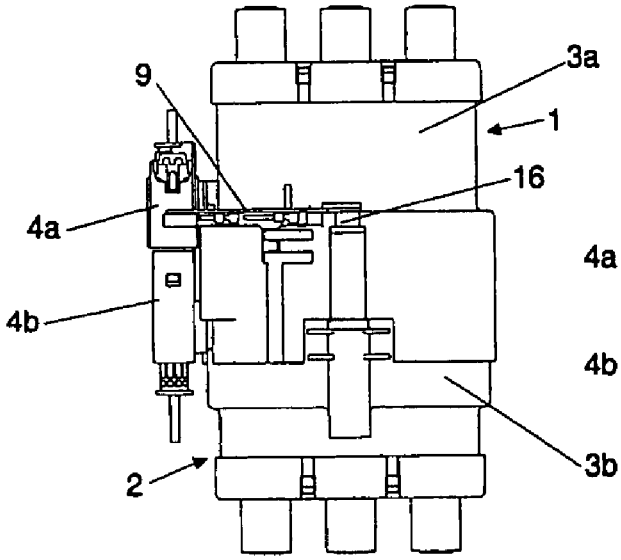
FIG. 5 illustrates a second connection phase for joining the connector parts.
Figure 6:
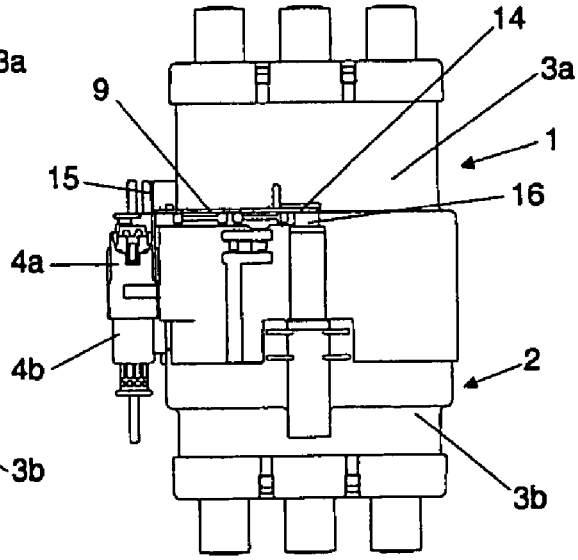
FIG. 6 illustrates a third connection phase for joining the connector parts.

Referring now to FIGS. 4, 5, and 6, with continual reference to FIGS. 1, 2, and 3, resulting connection phases for joining connector parts 1, 2 together to form the electrical connector are respectively shown. FIG. 4 illustrates a first connection phase for joining connector parts 1, 2. In the first connection phase, connector parts 1, 2 are not yet joined together. As such, HL housings 3*a*, 3*b* and LL housings 4*a*, 4*b* are not yet joined together. In the first connection phase, slider 9 is in position to block movement of LL housing 4*a* and locking bolt head 16 is freely accessible.

FIG. 5 illustrates a second connection phase for joining connector parts 1, 2. In the second connection phase, connector parts 1, 2 have been joined together with HL housings 3*a*, 3*b* being joined together and LL housings 4*a*, 4*b* not yet being joined together. In particular, HL housings 3*a*, 3*b* have been screwed together by twisting locking bolt 8. As such, the second connection phase represents an incomplete joining phase as LL housings 4*a*, 4*b* are not yet joined together. In this incomplete joining phase, bolt head 16 projects far enough from molded-on element 17*a* that actuation of slider 9 away from LL housing 4*a* continues to be blocked as lock 7 is not yet in its locked position.

Thus, only when lock 7 is moved to its locked position such that the HL connection(s) is completely established, as a result of HL contacts 5*a*, 5*b* joining together when HL housings 3*a*, 3*b* are joined together, can slider 9 be moved away from LL housing 4*a* into the position illustrated in FIG. 6. FIG. 6 illustrates a third connection phase for joining connector parts 1, 2. In the third connection phase, slider 9 releases LL housing 4*a* such that LL housing 4*a* may move downward along the plug-in direction to join with LL housing 4*b*. Upon LL housing 4*a* joining LL housing 4*b*, the HL connection is supplied with current via the circuit breaker. In this position of slider 9, slider end 14 also covers bolt head 16 thus making lock 7 inaccessible to manipulation. Additionally, wall 15 of LL housing 4*a* locks slider 9 in the position blocking lock 7 when LL housings 4*a*, 4*b* are joined.

Connector parts 1, 2 are detached and separated from one another in a reverse sequence. Connector parts 1, 2 cannot separate from one another until lock 7 is released. Releasing lock 7 requires slider 9 to move in the direction of LL housing 4*a*. In order for slider 9 to move in the direction of LL housing 4*a*, LL housings 4*a*, 4*b* have to be separated from one another. This occurs as a result of LL housing 4*a* being vertically moved upward in the plug-in direction away from LL housing 4*b*. The separation of LL housings 4*a*, 4*b* in turn causes the separation of LL contacts 6*a*, 6*b* and the LL connection therebetween. In response to the LL connection being separated, the circuit breaker interrupts the current supplied to the HL connection. As such, because lock 7 has to be released for connector parts 1, 2 to be able to separate from one another, lock 7 can only be released when slider 9 moves toward LL housing 4*a*, and slider 9 can only move toward LL housing 4*a* when LL housings 4*a*, 4*b* have been separated from one another such that the established LL connection is separated, separation of the HL connection is thus possible only in current-free and/or voltage-free states.

REFERENCE NUMERALS

| | |
|---|---|
| 1 | First plug-in connector part |
| 2 | Second plug-in connector part |
| 3a, 3b | High-load ("HL") housings |
| 4a, 4b | Low-load ("LL") housings |
| 5a, 5b | High-load ("HL") contacts |
| 6a, 6b | Low-load ("LL") contacts |
| 7 | Lock |
| 8 | Locking bolt |
| 9 | Slider |
| 10a, 10b | High-load ("HL") terminal lines |
| 11a, 11b | Low-load ("LL") terminal lines |
| 12 | Slider projection |
| 13 | Edge (on LL housing 4a) |
| 14 | Slider end |
| 15 | Wall (on LL housing 4a) |
| 16 | Locking bolt head |
| 17a, 17b | Molded-on elements |

While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. An electrical connector comprising:

a first connector part having a first high-load ("HL") housing and a first low-load ("LL") housing movably connected to the first HL housing to move along a plug-in path in opposite first and second directions;

a second connector part having a second HL housing and a second LL housing;

wherein the connector parts are movable relative to one another along the plug-in path to join together and to separate from one another;

wherein the HL housings join together upon the connector parts joining together;

wherein the LL housings join together after the first LL housing is moved in the first direction along the plug-in path toward the second LL housing while the connector parts are joined together;

a lock associated with the connector parts, wherein upon being accessed the lock is movable between a locked position in which the lock fastens the connector parts together when the connector parts are joined together and an unlocked position in which the lock allows the connector parts to separate from one another; and a slider movably connected to the first connector part, wherein the slider is transversely movable relative to the plug-in path between a first position in which the slider engages the first LL housing to prevent the first LL housing from moving along the plug-in path and a second position in which the slider disengages from the first LL housing such that the first LL housing is movable along the plug-in path;

wherein when the slider is in the first position the slider enables access to the lock and the lock engages the slider to prevent the slider from moving from the first position until the lock is in the locked position, and when the slider is in the second position and the lock is in the locked position the slider prevents access to the lock and the lock disengages from the slider to enable the slider to move from the second position;

wherein the first LL housing engages the slider to prevent the slider from moving from the second position while the LL housings are joined together, and the first LL housing disengages from the slider to allow the slider to move from the second position while the LL housings are separated from one another as a result of the first LL housing moving in the second direction along the plug-in path away from the second LL housing.

2. The connector of claim 1 wherein:

the lock includes a twistable locking bolt.

3. The connector of claim 2 wherein:

the locking bolt has a thread for establishing a screw connection between the connector parts.

4. An electrical connector comprising:

a first connector part having a first high-load housing with a first high-load contact and a first low-load housing with a first low-load contact, wherein the first low-load housing is movably connected to the first high-load housing to move along a plug-in path in opposite first and second directions;

a second connector part having a second high-load housing with a second high-load contact and a second low-load housing with a second low-load contact;

wherein the connector parts are movable relative to one another along the plug-in path to join together and are movable relative to one another along the plug-in path to separate from one another;

wherein the high-load housings join together upon the connector parts joining together such that the high-load contacts join together and establish an electrical high-load connection;

wherein the low-load housings join together after the first low-load housing is moved in the first direction along the plug-in path toward the second low-load housing while the connector parts are joined together such that the low-load contacts join together and establish an electrical low-load connection;

a lock associated with the first and second connector parts, wherein upon being accessed the lock is movable between a locked position in which the lock fastens the connector parts together when the connector parts are joined together and an unlocked position in which the lock allows the connector parts to separate from one another; and a slider movably connected to the first connector part, wherein the slider is transversely movable relative to the plug-in path between a first position in which the slider engages the first low-load housing to prevent the first low-load housing from moving along the plug-in path and a second position in which the slider disengages from the first low-load housing such that the first low-load housing is movable along the plug-in path;

wherein when the slider is in the first position the slider enables access to the lock and the lock engages the slider to prevent the slider from moving from the first position until the lock is in the locked position, and when the slider is in the second position and the lock is in the locked position the slider prevents access to the lock and the lock disengages from the slider to enable the slider to move from the second position;

wherein the first low-load housing engages the slider to prevent the slider from moving from the second position while the low-load housings are joined together, and the first low-load housing disengages from the slider to allow the slider to move from the second position while the low-load housings are separated from one another as a result of the first low-load housing moving in the second direction along the plug-in path away from the second low-load housing.

5. The connector of claim 4 wherein:

the contacts axially join together when the corresponding housings join together.

6. The connector of claim 4 wherein:

the second low-load housing is fixedly connected to the second high-load housing to stay in place.

7. The connector of claim 4 wherein:

the lock includes a twistable locking bolt.

8. The connector of claim 7 wherein:

the locking bolt has a thread for establishing a screw connection between the connector parts.

9. The connector of claim 4 further comprising:

high-load terminal lines respectively connected to the high-load contacts; and low-load terminal lines respectively connected to the low-load contacts.

10. The connector of claim 1 wherein: the second low-load housing is fixedly connected to the second high-load housing to stay in place.

* * * * *